US005611088A

United States Patent [19]

Almon

[11] Patent Number: 5,611,088

[45] Date of Patent: Mar. 18, 1997

[54] METHOD AND DEVICE FOR DISINFECTING A TOILET BOWL

[76] Inventor: Amy C. Almon, 410 Waverly Dr., Augusta, Ga. 30909

[21] Appl. No.: 843,027

[22] Filed: Feb. 28, 1992

[51] Int. Cl.[6] ..... E03D 9/02; C01B 15/01

[52] U.S. Cl. ..... 4/222; 4/DIG. 9; 204/175; 204/271; 204/284; 205/466

[58] Field of Search ..... 4/222, DIG. 9, 4/DIG. 10; 204/149, 175, 271, 284, 293, 84; 210/759

[56] References Cited

U.S. PATENT DOCUMENTS

| | | | |
|---|---|---|---|
| 583,131 | 5/1897 | Stiebel, Jr. . | |
| 1,404,155 | 1/1922 | Littlefield | 4/DIG. 9 |
| 2,022,650 | 12/1935 | Dawsey | 204/175 |
| 3,774,246 | 11/1973 | Beer | 204/149 X |
| 3,969,201 | 7/1976 | Oloman et al. | 204/84 X |
| 4,676,878 | 6/1987 | Chez | 204/84 X |
| 4,758,317 | 7/1988 | Chiang | 204/84 |

FOREIGN PATENT DOCUMENTS

| | | | |
|---|---|---|---|
| 25681 | 5/1912 | United Kingdom | 204/175 |
| 8582 | 6/1913 | United Kingdom | 204/84 |

*Primary Examiner*—William A. Cuchlinski, Jr.
*Assistant Examiner*—John L. Beres
*Attorney, Agent, or Firm*—Harold M. Dixon; William R. Moser; Paul A. Gottleib

[57] ABSTRACT

Method and device for disinfecting a flush toilet. The device is an electrocell mounted in the tank of the toilet, with two wire mesh electrodes immersed in the water in the tank and a battery applying approximately one to two volts of electric potential to the electrodes so that they chemically reduce a portion of the water in the tank to hydrogen peroxide. Then, when the tank is flushed, the peroxide is carried into the bowl where it can kill bacteria.

18 Claims, 1 Drawing Sheet

METHOD AND DEVICE FOR DISINFECTING A TOILET BOWL

The present invention relates to methods and devices for disinfecting the bowl of a flush toilet. The United States Government has rights in this invention pursuant to Contract No. DE-AC0989SR18035 between the U.S. Department of Energy and Westinghouse Savannah River Company.

BACKGROUND OF THE INVENTION

FIELD OF THE INVENTION

DISCUSSION OF BACKGROUND

Use of a flush toilet inevitably leads to the build up of bacteria in the bowl. Periodic scrubbing of the bowl in combination with an antiseptic and antibacterial cleaner is a part of normal housekeeping. Cleaning agents are commercially available for installation in a toilet tank to reduce the rate of bacterial buildup between manual cleanings. These cleaning agents are usually installed in the tank and introduce chlorine bleach directly into the bowl with each flushing. However, these chemicals are harsh. Furthermore, the cleaning agent must be replaced every ninety days or so and is relatively expensive.

Hydrogen peroxide is a well-known disinfectant. Furthermore, it is known that hydrogen peroxide can be generated by applying a small voltage across two electrodes in water. See U.S. Pat. No. 2,022,650 issued to Dawsey in 1935 for a description of the use of peroxide so generated for sterilizing drinking water.

Also, measuring the change in the conductivity of the liquid in a toilet bowl to initiate a flushing automatically is described in Stiebel, Jr.'s U.S. Pat. No. 584,131, issued in 1897.

SUMMARY OF THE INVENTION

According to its major aspects, the present invention is a flush toilet, or a device for use with a flush toilet, and a method for disinfecting the bowl of a flush toilet. An electrocell is mounted in the tank of the toilet, with two wire mesh electrodes immersed in the water of the tank and a battery applying approximately one to two volts of electric potential to the electrodes. The battery is preferably carried in a water-proof case attached to the tank wall. The electrocell reduces a portion of the water in the tank to hydrogen peroxide, an antiseptic. Then, when the tank is flushed, the peroxide in it kills bacteria in the bowl.

The electrocell mounted in the tank is an important feature of the present invention. In the tank, the electrocell is not in view, does not interfere with the flushing action and is not in a position to trap bacteria itself in the wire mesh.

The use of hydrogen peroxide as an antiseptic is another feature of the present invention. Hydrogen peroxide is not likely to harm the toilet tank or bowl and is not hazardous in the concentrations generated in the present invention.

The use of a small battery, such as a 1.5 volt battery, is another feature of the present invention. Use of a battery eliminates an electrical cord and transformer from an AC source. Also, batteries of this voltage are readily available.

The use of metal mesh electrodes, preferably stainless steel mesh electrodes, is another feature of the present invention. Mesh provides a large surface area and steel mesh is inexpensive.

These and other features of the present invention will be readily apparent to those skilled in the art of flush toilet disinfection from a careful reading of the detailed description herein accompanied by the following drawings.

DETAILED DESCRIPTION OF A PREFERRED EMBODIMENT

Figure 1:
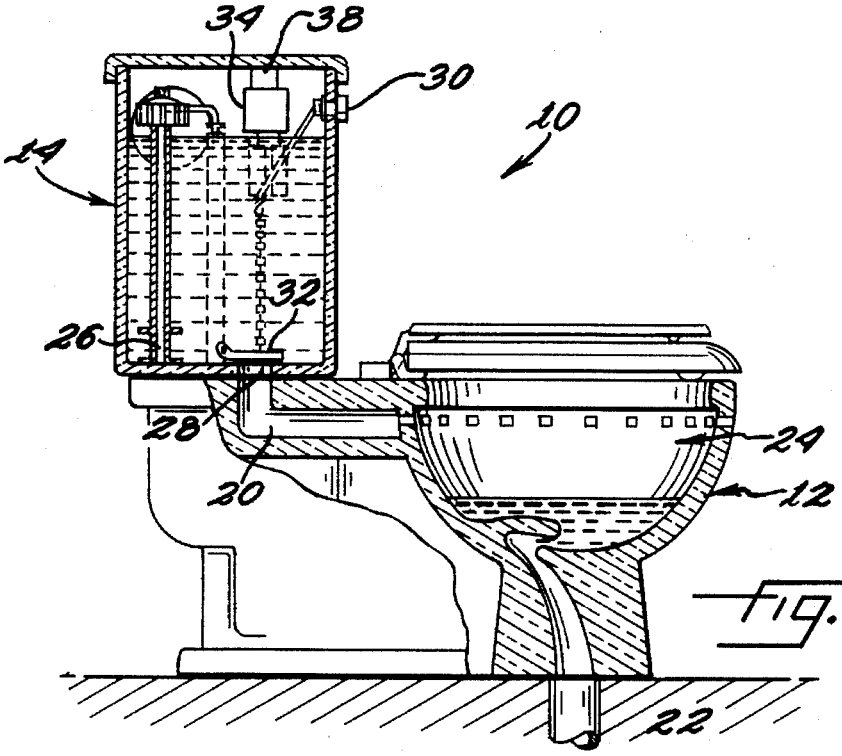
FIG. 1 is a side, cross-sectional view of a flush toilet according to a preferred embodiment of the present invention.
Figure 2:
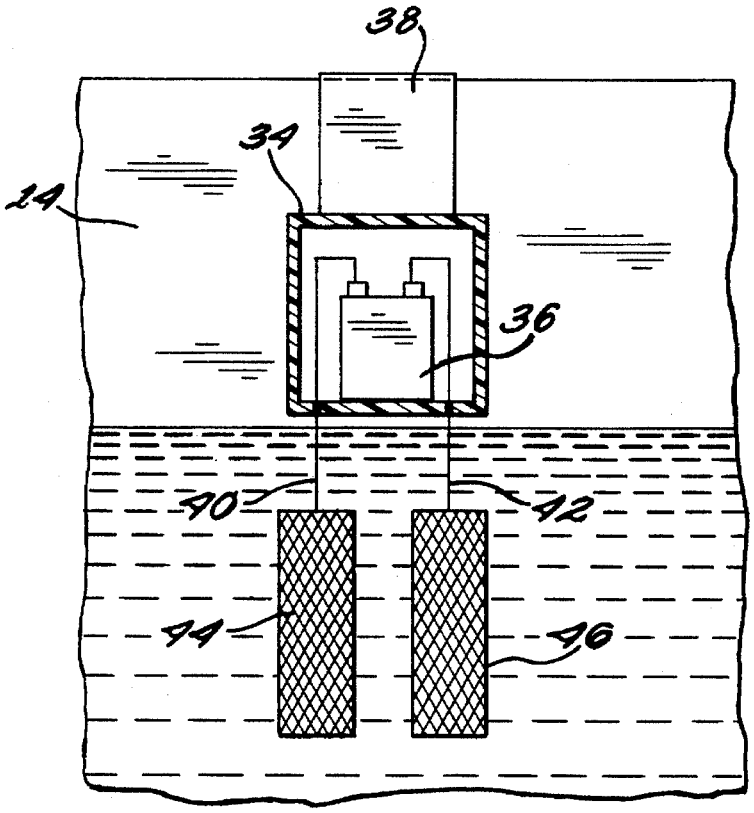
FIG. 2 is a front, cross-sectional view of the tank of a flush toilet according to a preferred embodiment of the present invention.

Referring now to FIGS. 1 and 2, the present invention is a device for use with a flush toilet that will kill bacteria in the bowl of the toilet with each flush. There is illustrated in FIG. 1 a side, cross-sectional view of a typical flush toilet 10, having a bowl 12 and a tank 14. Bowl 12 has an inlet 20, an outlet 22 and an opening 24 for receipt of wastes such as urine and feces. Tank 14 has an inlet 26 and an outlet 28 and is dimensioned to hold a quantity of water sufficient for flushing bowl 12. Inlet 26 receives make-up water following a flushing and water leaves tank 14 through outlet 28 and enters inlet 20 of bowl 12 where it is dispersed from the top of bowl 12 down its inside surface to outlet 22 and thence to a sewer or septic tank (not shown).

Flushing is usually manually initiated by pressing a lever 30 on tank 14 that opens a valve 32 that normally seals outlet 28. When tank 14 is emptied, valve 32 closes and tank 14 refloods with make-up water.

Carried by the wall of tank 14 is a case 34 containing an electrical battery 36 capable of producing at least one volt and preferably between one and two volts, such as a 1.5 volt battery, as are commercially available. Case 34 is preferably waterproof and is suspended from the rim of tank 14 by a support 38 so that it remains above the water line. Two wires 40, 42 connect the terminals of battery 36 to a pair of spaced apart electrodes 44, 46 immersed in the water. Electrodes 44, 46 are preferably made of a metal mesh for large surface area per unit weight and most preferably made of steel mesh for low cost.

In the presence of the voltage applied by battery 36 to electrodes 44, 46, a portion of the water molecules in tank 14 are chemically reduced to hydrogen peroxide. When tank 14 is flushed, hydrogen peroxide leaves tank 14 and enters bowl 12.

The reactions that takes place are:

$$H_2O \rightarrow 2H^+ + \tfrac{1}{2}O_2 + 2e \text{ (Anode)}$$

$$H_2O + \tfrac{1}{2}O_2 + e \rightarrow H_2O_2 \text{ (Cathode)}$$

Since the peroxide is generated from the water in the tank itself, no additional chemicals are required.

In use, case 34 is suspended from tank 14 by support 38 so that electrodes 44, 46 are immersed in the water and, preferably case 38 is above it. Battery 36 is placed in case 38 and connected electrically to wires 40, 42. Then, toilet 10 is periodically flushed to send the hydrogen peroxide generated by the applied voltage to the inside surface of bowl 12.

It will be apparent to those skilled in the art that many changes and substitutions can be made to the preferred embodiment herein described without departing from the spirit and scope of the present invention as defined by the appended claims.

What is claimed is:

1. A flush toilet, comprising a bowl having an opening for receiving waste materials and an inlet and an outlet;

a tank mounted to said bowl, said tank dimensioned for holding a quantity of water, said tank having an inlet and an outlet, said tank in communication with said inlet of said bowl; and means for electrochemically reducing a portion of said water in said tank to hydrogen peroxide so that said bowl will be disinfected when said hydrogen peroxide enters said bowl through said outlet of said tank.

2. The flush toilet as recited in claim 1, wherein said reducing means further comprises an electrocell in said tank.

3. The flush toilet as recited in claim 1, wherein said reducing means further comprises:

a pair of electrodes immersed in said water of said tank; and means for applying an electric potential across said electrodes.

4. The flush toilet as recited in claim 1, wherein said reducing means further comprises:

a pair of electrodes immersed in said water of said tank, said electrodes being made of a wire mesh; and means in electrical connection with said electrodes for applying an electric potential across said electrodes.

5. The flush toilet as recited in claim 1, wherein said reducing means further comprises:

a pair of electrodes immersed in said tank of said water; and a battery for applying an electric potential across said electrodes, said battery mounted within said tank.

6. The flush toilet as recited in claim 1, wherein said reducing means further comprises:

a pair of electrodes immersed in said tank of said water; and a source of approximately at least one volt of electric potential applied across said electrodes, said source in electrical connection with said electrodes.

7. The flush toilet as recited in claim 1, wherein said reducing means further comprises:

a pair of electrodes immersed in said water of said tank;

a waterproof case mounted within said tank;

a battery in said case for providing an electrical potential; and means for connecting said battery to said pair of electrodes.

8. The flush toilet as recited in claim 1, wherein said reducing means further comprises:

a pair of wire mesh electrodes immersed in said water of said tank;

a battery mounted in said tank and in electrical connection with said electrodes, said battery adapted to provide approximately one to two volts of electrical potential.

9. A device for use with a flush toilet having a tank containing water, said device comprising:

a pair of electrodes mounted within said tank and immersed in said water;

a battery in said tank;

means for connecting said battery to said electrodes so that said battery may apply a voltage across said electrodes and thereby produce hydrogen peroxide from a portion of said water in said tank.

10. The device as recited in claim 9, further comprising a case for said battery, said case being substantially waterproof and carried by said tank.

11. The device as recited in claim 9, wherein said electrodes are made of a wire mesh.

12. The device as recited in claim 9, wherein said electrodes are made of steel mesh.

13. The device as recited in claim 9, wherein said electrodes are made of wire mesh and said battery can provide an electrical potential of approximately one to two volts.

14. The device as recited in claim 9, wherein said electrodes are made of wire mesh and said battery can provide an electrical potential of approximately one to two volts and further comprising a case for said battery, said case carried by said tank and being substantially water-proof.

15. A method for disinfecting the bowl of a flush toilet having a tank containing water for flushing, said method comprising the steps of:

immersing a pair of electrodes in said water;

applying an electrical potential across said electrodes so that said applied potential produces hydrogen peroxide in said water; and periodically flushing said toilet.

16. The method as recited in claim 15, wherein said electrodes are made of wire mesh.

17. The method as recited in claim 15, wherein said electrodes are made of steel mesh.

18. The method as recited in claim 15, wherein said electrical potential is between approximately one volt and two volts.

* * * * *